United States Patent [19]

Keith

[11] 4,030,023

[45] June 14, 1977

[54] TEMPERATURE COMPENSATED CONSTANT VOLTAGE APPARATUS

[75] Inventor: John L. Keith, Garland, Tex.

[73] Assignee: Rockwell International Corporation, El Segundo, Calif.

[22] Filed: May 25, 1976

[21] Appl. No.: 689,877

[52] U.S. Cl. ..... 323/4; 307/28 S; 307/297; 307/302; 323/22 Z; 323/69

[51] Int. Cl.² ..... G05F 1/58

[58] Field of Search ..... 323/1, 4, 9, 22 Z, 17, 323/68, 69, 22 T; 307/285, 296, 297, 302

[56] References Cited

UNITED STATES PATENTS

| | | | |
|---|---|---|---|
| 3,577,062 | 5/1971 | Hoffman | 323/17 |
| 3,701,004 | 10/1972 | Tuccinardi et al. | 323/22 Z |
| 3,956,661 | 5/1976 | Sakamoto et al. | 323/22 T |

OTHER PUBLICATIONS

*Instruments and Control Systems*, Mar. 1971, pp. 133–135, "Solid State Voltage References", by Hineman et al.

*IBM Tech. Disc. Bulletin*, vol. 15, No. 5., Oct. 1972, "Precision Voltage Source With High-Speed Polarity Control", by Hellwarth et al.

*Primary Examiner*—Gerald Goldberg

*Attorney, Agent, or Firm*—Bruce C. Lutz; Robert J. Crawford

[57] ABSTRACT

A temperature compensated constant voltage circuit utilizing a constant current supply circuit having a positive temperature coefficient of current for supplying current to a nearly constant voltage dropping circuit. The voltage dropping circuit includes a zener diode which has a negative temperature coefficient. The combination of the positive and negative coefficients cooperate to produce a temperature stable constant voltage circuit.

2 Claims, 1 Drawing Figure

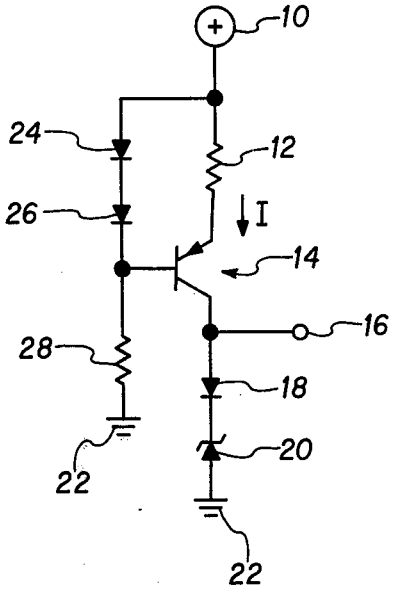
10
24
12
26
I
14
16
28
18
20
22
22

TEMPERATURE COMPENSATED CONSTANT VOLTAGE APPARATUS

THE INVENTION

The present invention is generally concerned with electronics and is more specifically concerned with providing a temperature compensated constant voltage circuit.

Although there are various constant voltage power supplies in the prior art, the present circuit is believed to provide all the constant voltage characteristics found in the prior art but is less complicated in using fewer parts and being easier to calibrate while still maintaining the temperature stability of much more expensive prior art units.

The operation of the circuit utilizes a constant current source supplying current to a constant voltage zener diode. Since the zener diode is temperature dependent as to its voltage, the current supplied from the constant current source is designed to vary in the opposite direction with temperature as compared to the direction of variationwith temperature of the zener diode. This compensation can be obtained without doing any matching other than the initial matching in the design stage using published characteristics of solid state components.

It is, therefore, an object of the present invention to provide an improved constant voltage supply.

Other objects and advantages of the present invention may be ascertained from a reading of the specification and appended claims in conjunction with the single drawing which is a schematic diagram of a preferred embodiment of the inventive concept.

In the figure a positive power supply potential 10 supplies current through a resistor 12 to the emitter of a transistor generally designated as 14. The collector of transistor 14 is connected to an output terminal 16 and is also connected through a diode 18 and a zener diode 20 to ground or reference potential 22. The anode of diode 18 is connected to output 16 while the anode of zener diode 20 is connected to ground 22. A pair of diodes 24 and 26 are connected in series between positive terminal 10 and the base of transistor 14 such that the direction of easy current flow for both diodes is toward the base of transistor 14. A resistor 28 is connected between the base of transistor 14 and ground 22.

The present disclosure utilizes a PNP transistor. A copending application Ser. No. 690,206 filed on even date herewith in my name and assigned to the same assignee as the present invention illustrates the use of this circuit when a NPN transistor is used.

As indicated above, the function of the present circuit is to provide a temperature stable voltage reference. This is accomplished by taking advantage of the temperature variations found in various semiconductor devices. Zener diodes in the 1N700 Series have temperature coefficients which go from $-\alpha$ to $+\alpha$ where $\alpha$ (alpha) is defined herein as the temperature coefficient of a zener diode which relates the change in zener voltage to a change in temperature; usually expressed as (%/° C)which gives $\alpha$ in terms of a percent change of the 25° C zener voltage per ° C temperature change. Note also this term is used here to represent the change in a small signal diode forward bias drop voltage with a change in temperature. The zener diode 20 in a preferred embodiment of the circuit was a 1N753. This zener diode has a $+\alpha$ so that the zener voltage increases with temperature. Since a zener diode also increases in voltage with current, it is normally necessary that the current flow through a zener diode be kept constant and the diode be kept at a constant temperature in order to obtain a stable output voltage. The present inventive concept, however, utilizes these features by varying the amount of current slightly to compensate for the variation of the zener diode with temperature.

It should first be noted that small signal silicon diodes such as 18 have a negative $\alpha$ so that the forward drop decreases with temperature. The net result of connecting diode 18 in series with zener diode 20 is partial compensation of the voltage temperature sensitivity of zener 20.

To improve the temperature stability of the overall network, the zener diode 20 and associated diode 18 are fed by the constant current source comprising the rest of the illustrated circuit. This constant current source provides a current which decreases with increases in temperature but remains constant with changes in power supply potential at terminal 10. Thus, the increase in voltage across zener 20 which occurs with temperature is minimized by decreasing the current supplied to the doide with temperature thereby stabilizing the voltage.

The constant current circuit is a common emitter amplifier which is biased into the active region of its Ic/VCE curve. The bias level of this transistor 14 is determined by the voltage at the base with respect to the positive terminal 10. If the voltage at 10 is 12 volts, the voltage at the base of transistor 14 will be approximately 10.8 volts due to the fact that diodes 24 and 26 are forward biased through resistor 28 due to the approximate 0.6 volt drop across each of the diodes.

The emitter of transistor 14 will track the base voltage less the base-emitter voltage drop ($V_{be}$) so that the voltage across resistor 12 will be equal to ($V_{24} + V_{26} - V_{be}$). Therefore, the current $I_{12}$ will equal ($V_{24} + V_{26} - V_{be}$) ($1/R_{12}$). This will force the collector current to remain constant with variations in $V_{ce}$ (the voltage between collector and emitter of transistor 14). Also, this current will have a temperature dependence of $[(\Delta V_{24} + \Delta_{26} - \Delta V_{be})\ 1/R_{12}]/°$ C which is approximately $\Delta V_{24}/R_{12}/°$ C because $\Delta V_{be}$ and $\Delta V_{26}$ track reasonably well and their temperature effects tend to cancel one another.

In attempting to design a circuit to have a temperature compensated constant voltage output, it will be determined that the change in output voltage with temperature ($\Delta V_{12}/\Delta\tau$) can be calculated using the following formula:

$$\Delta V_{16}/\Delta\tau = \Delta V_{20}/\Delta\tau + \Delta V_{18}/\Delta\tau + (\Delta V_{20}/\Delta I_{12})(\Delta I_{12}/\Delta\tau).$$

As will be realized, $I_{12}$ is the current through resistor 12 and may be determined by dividing the resistance of resistor 12 into the voltage thereacross and $\Delta\tau$ is an increment of temperature. The voltage across 12 or $V_{12}$ is equal to the sum of the voltages $V_{24} + V_{26} = V_{be}$. For the purposes of these calculations, the emitter and collector currents are assumed to be equal where the base current is comparatively small. In other words, the transistor has a gain of 100 or more. $V_{24}$, $V_{26}$, $V_{18}$ and $V_{20}$ are respectively the voltages across the associated diodes from positive to less positive potentials. $V_{be}$ is similarly the forward bias voltage of the base emitter junction.

From the information and formulas provided supra, it will be apparent to those skilled in the art that the value of resistor 12 can be selected so that the variation with temperature of I is such that the effect on the voltage dropping circuit is to produce a substantially zero voltage change with temperature. The selection of this resistor 12 operates in conjunction with the temperature varying voltage drop across diode 24 to correctly modulate the bias of transistor 14 to accomplish the desired temperature varying current I.

In a preferred embodiment of the invention, the diodes 18, 24 and 26 were all 1N914, the resistor 12 was rated at 68 ohms, the diode 20 was a 1N753, the resistor 28 was 10K, and the transistor 14 was a 2N3906 while the power supply was 12 volts. Further, in this preferred embodiment, the formula provided above using standard specification provided values provided an indication or voltage change per ° C which corresponds to an error of 0.004% change per ° C. By decreasing the resistance of resistor 12 to 25 ohms, and accepting the penalty of increased current drain, the change with temperature can be reduced to as little as 0.0009%/° C.

While a single preferred embodiment has been illustrated and a second embodiment has been referenced, it will be realized that other implementations of the invention will be apparent to those skilled in the art. Thus, I wish to be limited only by the scope of the appended claims.

What is claimed is:

1. Temperature compensated constant voltage apparatus comprising, in combination:

power supply means including first and second terminal means;

transistor means including base, emitter and collector means;

first resistive means connected between said first terminal means and said base means;

apparatus output means connected to said collector means for outputting a constant voltage;

second resistive means connected between said emitter means and said second terminal means;

first diode means, comprising two diodes connected in series each having the same direction of easy current flow, connected between said base means and said second terminal means; and second diode means, including at least a zener diode and a further diode having a direction of easy current flow opposite that of the zener diode, connected between said collector means and said first terminal means.

2. Apparatus as claimed in claim 1 wherein the temperature coefficients of resistance of said first diode means are opposite and complementary the temperature coefficients of said second diode means for producing a temperature compensated circuit.

* * * * *

UNITED STATES PATENT AND TRADEMARK OFFICE

CERTIFICATE OF CORRECTION

PATENT NO. : 4,030,023

DATED : June 14, 1977

INVENTOR(S) : John L. Keith

It is certified that error appears in the above-identified patent and that said Letters Patent are hereby corrected as shown below:

Col. 1, line 23, "variationwith" should be --variation with--;

Col. 2, line 26, "doide" should be --diode--;

Col. 2, line 45, "$\Delta_{26}$" should be --$\Delta V_{26}$--; and

Col. 2, line 62, "$V_{24} + V_{26} = V_{he}$" should be --$V_{24} + V_{26} - V_{be}$--.

Signed and Sealed this thirtieth Day of August 1977

[SEAL]

*Attest:*

RUTH C. MASON
*Attesting Officer*

C. MARSHALL DANN
*Commissioner of Patents and Trademarks*